United States Patent [19]

Autrey

[11] 4,075,721

[45] Feb. 28, 1978

[54] MATTRESS CONSTRUCTION AND METHOD OF MAKING

[75] Inventor: William L. Autrey, 13612 Carroll Way, Tustin, Calif. 92680

[73] Assignee: William L. Autrey, Tustin, Calif.

[21] Appl. No.: 790,518

[22] Filed: Apr. 25, 1977

Related U.S. Application Data

[62] Division of Ser. No. 638,564, Dec. 8, 1975, Pat. No. 4,019,451.

[51] Int. Cl.[2] ..... A47C 23/00

[52] U.S. Cl. ..... 5/345 R; 3/351

[58] Field of Search ..... 5/345 R, 351, 353, 355, 5/361 R, 361 B; 112/3 R, 262

[56] References Cited

U.S. PATENT DOCUMENTS

| | | | |
|---|---|---|---|
| 2,770,816 | 11/1956 | Reisny | 5/355 |
| 3,649,974 | 3/1972 | Baruth | 5/345 R |
| 3,822,426 | 7/1974 | Mistarz | 5/351 |
| 3,848,283 | 11/1974 | Ikeda | 5/351 |

*Primary Examiner*—Casmir A. Nunberg

*Attorney, Agent, or Firm*—Warren T. Jessup

[57] ABSTRACT

A mattress construction and method of making is disclosed in which an extremely wide, deep stitch flange permits a more uniform and tighter mattress construction. A mattress cover is sewn to an apron or flanging material with a wide border or flange with the thread being deeply set in the cover by the thick foam padding between the flange material and the cover. This construction allows the apron to be very tightly pulled over a coil spring and stapled through sisal padding to the coil spring rim or border. The stretching of the flange skirt and cover creates a bow in the coil spring pulling the rim toward the center. The wide flange then permits the skirt or side cover to be tightly stitched with edging tape or binding material to produce a very firm and flat mattress construction.

2 Claims, 3 Drawing Figures

MATTRESS CONSTRUCTION AND METHOD OF MAKING

This is a division of application Ser. No. 638,564, filed Dec. 8, 1975, now U.S. Pat. No. 4,019,451.

BACKGROUND OF THE INVENTION

This invention relates generally to methods of making mattresses and more particularly relates to methods of attaching cover material to produce a firm, uniform mattress construction.

In the construction of mattresses a padding is placed on either side of a coil spring construction and a cover is sewn over the spring. The cover is usually produced with a narrow quarter-inch flange to which edging or binding material is sewn. This construction sometimes requires loose padding in areas in order to provide a firm, flat mattress. In addition foam padding between the cover material and the flanging material usually is not much greater than one-quarter of an inch. Also, the edges of the mattress frequently came out narrower than the center of the mattress causing a curved or convex construction which is generally undesirable. The method and construction of the present invention eliminates most of these difficulties and produces a strong, flat, uniform construction.

SUMMARY OF THE INVENTION

The purpose of the present invention is to permit uniform, flat construction of mattresses.

The advantages of the present invention are produced by sewing cover material with ticking attached to an apron or flanging material with a relatively thick pad of foam material sandwiched therebetween. The flanging material is sewn to the cover material more than one inch from the edge in order to produce a wide flange or border. This sewing of the flanging material or apron more than one inch from the edge also permits use of relatively thick piece of foam padding which has the advantage of producing a deep stitch which is not easily unravelled. The wide flange and flanging material permit the cover to be pulled very taut over coil springs and stapled over the sisal padding to the wire rim of the coil springs. The cover is preferably pulled tight enough to bow the springs producing a convex shape on the upper surface. Attachment of the cover to the lower surface tends to bulge the spring in the opposite direction, pulling the rim wire toward the center, making a very firm and flat construction.

The tightness of the cover has an additional advantage in that the strength of material used for producing the coil spring need not be as rigid. Thus this construction can produce a relatively resilient mattress which is almost perfectly flat and firm. The side cover or skirt around the sides of the mattress is sewn to the top and bottom covers with a tape or binding material. When the final binding material is sewn to the bottom cover, the mattress or cover is pulled firm to stretch the foam padding laterally to completely flatten the mattress and produce a unitary, firm and solid construction.

It is one object of the present invention to produce a mattress construction having a relatively wide flange or border in order to permit the covering material to be pulled extremely tight.

Another object of the present invention is to provide a mattress construction having a wide flange to permit use of a thicker foam padding between the springs and cover of the mattress.

Yet another object of the present invention is to provide a mattress construction which produces a flange having a deep channel stitch to reduce possibilities of splitting or unravelling.

Still another object of the present invention is to provide a new method of attaching covering material to coil springs to produce a uniform and firm mattress construction.

Other objects, advantages and novel features of the invention will become apparent from the following detailed description of the invention when considered in conjunction with the accompanying drawings, wherein like reference numbers identify like parts throughout.

DETAILED DESCRIPTION OF THE PREFERRED EMBODIMENT

Figure 1:
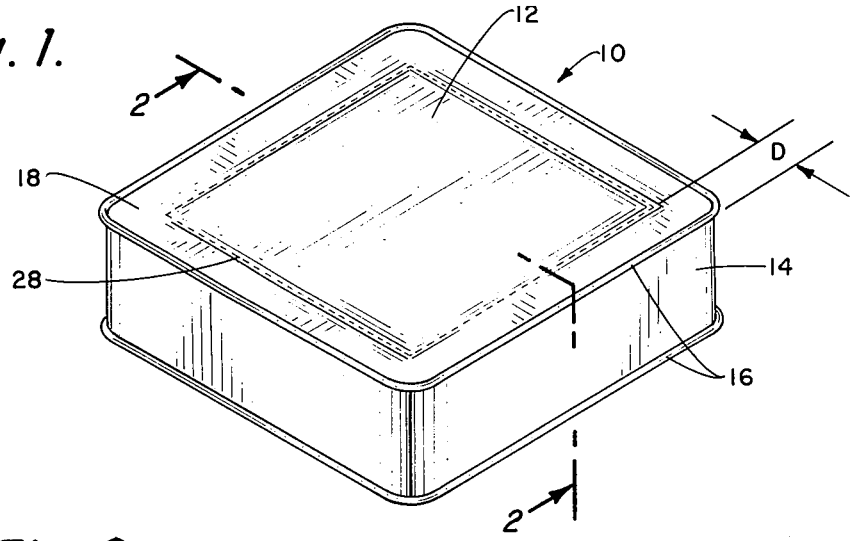
FIG. 1 is a top view of the mattress construction illustrating the wide flange construction.

FIG. 1 illustrates a mattress generally indicated at 10 having a top cover 12 which is the same as the bottom cover 22. A skirt or side cover 14 is joined to the covers 12 and 22 around the edges by a tape or ribbing 16. The covers 12 and 22, both top and bottom, have a wide flange 18 extending around the periphery of the mattress which permits a very tight unitary construction. This flange 18 is provided with a minimum width which permits the cover 12 to be pulled very taut over the spring 20 (FIG. 2).

Figure 2:
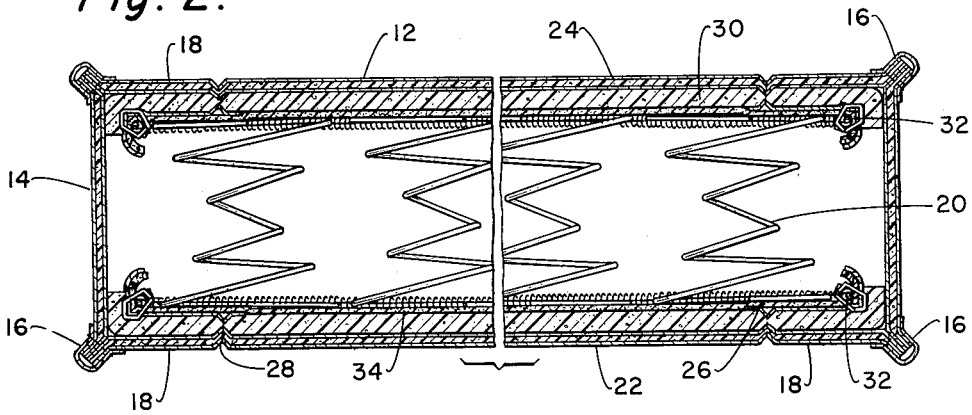
FIG. 2 is a sectional view taken at 2—2 of FIG. 1 illustrating the manner in which the wide flange permits a uniform, solid construction when the cover material is attached to the coil springs.

A sectional view of the mattress construction is shown in FIG. 2 and is taken at 2—2 of FIG. 1. The coil spring 20 is of conventional construction and may have any number of coils of any particular strength, depending upon the firmness and thickness of the mattress required. That is, in the case of mattresses for hide-a-beds, less thickness is required because the mattress must be folded. In addition, the coils must be of a smaller and more flexible gauge to permit this folding. In some cases the additional strength and firmness produced by the cover construction of the mattress of this invention permits a reduction in the cost of the coil sring 20 by allowing less coils and/or smaller guage wire to be used.

The top and bottom covers 12, 22 are securely fastened to the skirt or side cover 14 by the binding tape 16. The binding 16 is first secured to the bottom cover 22, which identical to the top cover 12. The mattres is then turned over and the binding 16 is then sewn to the flange 18 of the top cover 12 with the top cover being pulled very tightly to stretch the foam laterally over the springs to produce a firm, uniform, relatively flat and square construction.

Figure 3:
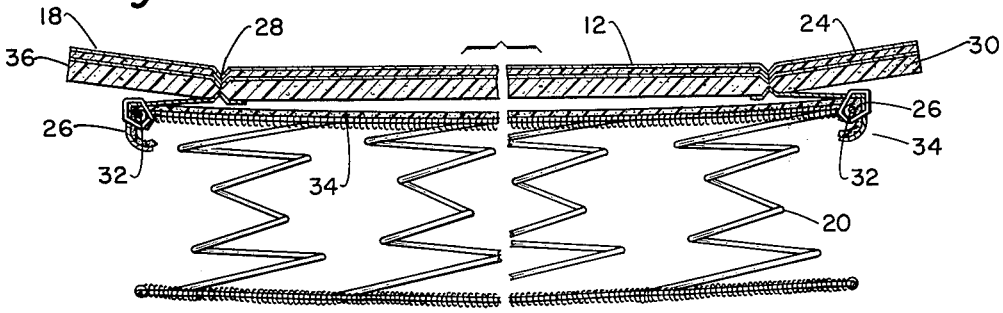
FIG. 3 is a view showing attachment of one cover by the apron or flange material to a coil spring assembly.

FIG. 3 illustrates the manner of attaching one cover to the coil spring 20. The cover 12, as well as the bottom cover 22, are comprised of a fabric 24 having a backing (called ticking) which is sewn to a flange cloth or apron 26 at a point (stitch 28) which produces a wide flange 18 in the cover 12. The flange cloth or aprong 26 is usually a piece of scrap material approximately six inches or more wide sewn to the cover 12 at stitch 28. Between the flange cloth 26 and the fabric 24 is a foam padding 30 which may be three-quarters of an inch or more in thickness. Ordinarily this foam padding is no more than a quarter of an inch because the flange 18 is sewn very close to the edge of the cover. The use of the thicker foam padding 30 produces a deep channel at the stich 28 which buries the thread preventing it from being easily worn or unravelled. Additionally, this type of construction allows the flange cloth 26 to be pulled very tightly over the rim wire 32 of the coil spring 20 until the spring bows in a concave fashion as shown. Attachment of the bottom cover 22 in the same fashion as the top cover 12 tends to cause the coil sring 20 to bow back in the other direction, producing and increasing the strength of the spring and mattress construction. A sisal matting 34 or padding is provided on each side of the coil spring 20 beneath the foam 30 to prevent the springs from damaging the foam padding.

The cover assemblies, comprised of the cover 12, foam pad 30 and flange material 26, are attached to the spring both top and bottom in the manner shown in FIG. 3. This permits an extremely tight and square, uniform construction to be produced when the skirt or side cover 14 is attached to the edge of the flange 18 in cover 12 with the ribbing or tape 16. The skirt 14 is first sewn to either the top or bottom cover and then is sewn to the opposite cover with the flange 18 providing a relatively wide piece of material for pulling the entire cover extremely tight to stretch the cover 12 and foam pad 30 laterally when attaching the ribbing or tape 16. The stitching 28 is preferably 2½ inches from the edge 36 of the foam or cover material to produce a wide flange 18 of approximately 2 inches (dimension D) when the entire construction is completed. An additional advantage of this construction is that you not only get the vertical cushioning of the foam 30 involved, but you also get some additional cushioning by the lateral or horizontal stretching of the foam when the cover is pulled extremely tight.

Thus there has been disclosed a method of constructing a mattress which permits the use of a thicker foam and provides a better padding by allowing the foam to be very tightly stretched with the cover over the coil spring. In addition this constuction produces a mattress which is much more durable in construction because the tightly secured cover permits a relatively unitary construction which does not allow any portion of the cover, sisal padding, foam or coil spring to move relative to one another. Thus the mattress maintains its shape substantially throughout the life of the cover material 12.

Obviously, many modifications and variations of the present invention are possible in the light of the above teachings. It is therefore to be understood that the full scope of the invention is not limited to the details described herein and may be practiced otherwise than as specifically described.

What is claimed is:

1. A compact, unitary mattress construction comprising:

a coil spring assembly;

a pair of covers attached to said spring with a flange material stitched to said cover to provide a wide flange;

a thick foam pad between the cover and the flange material, the thickness of said pad producing a deep channel stitch when the flange material is sewn to the cover; and a side cover stitched to said pair of covers around the periphery of said wide flange with a binding tape to produce a unitary squared construction;

said wide flange causing said covers and foam pads to be stretched laterally flat over said coil spring assembly.

2. The mattress construction according to claim 1 wherein said flange for pulling the cover and pad tightly over the coil spring assembly is more than one-and-one-half inches wide.

* * * * *